US005414436A

United States Patent [19]

Shinkawa et al.

[11] Patent Number: 5,414,436

[45] Date of Patent: May 9, 1995

[54] ELECTRIC EXTENSIBLE CAR ANTENNA

[75] Inventors: Masaki Shinkawa; Misao Kimura, both of Kanagawa, Japan

[73] Assignee: Harada Kogyo Kabushiki Kaisha, Tokyo, Japan

[21] Appl. No.: 97,668

[22] Filed: Jul. 26, 1993

[51] Int. Cl.[6] ..... H01Q 1/32; H01Q 1/10; H01Q 1/14

[52] U.S. Cl. ..... 343/715; 343/900; 343/903; 343/901

[58] Field of Search ..... 343/715, 878, 883, 888, 343/900, 901, 903, 711; H01Q 1/32, 1/14, 1/10, 9/30

[56] References Cited

U.S. PATENT DOCUMENTS

| | | | |
|---|---|---|---|
| 4,847,629 | 7/1989 | Shimazaki | 343/715 |
| 4,864,322 | 9/1989 | Yamamoto et al. | 343/715 |
| 4,902,472 | 2/1990 | Isobe et al. | 420/49 |
| 5,072,230 | 12/1991 | Taniyoshi et al. | 343/715 |
| 5,079,562 | 1/1992 | Yarsunas et al. | 343/715 |
| 5,189,435 | 2/1993 | Yarsunas et al. | 343/715 |

*Primary Examiner*—Donald Hajec
*Assistant Examiner*—Hoanganh Le
*Attorney, Agent, or Firm*—Koda and Androlia

[57] ABSTRACT

An electric extensible car antenna including an antenna element support cylinder detachably mounted to a cylindrical support member of an antenna attachment base from the outside of a car body; a single small-diameter rod antenna element inserted in an antenna element insertion hole of the support cylinder so as to be in contact with a conductive contact element; the proximal part of the antenna element led toward the proximal end of the support cylinder being guided in a direction by an antenna element guiding tube; and an antenna element extended and retracted by a rack-equipped flexible rope connected to the antenna element via an electric mechanism. It is desirable that the antenna element be made of an ultra-flexible material and that the support cylinder is made of a plurality of separate cylindrical units. Thus, the antenna has a very small risk of becoming damaged, has a simple construction, allows easy manufacturing, allows stable attachment of the antenna element, is highly compatible in terms of components, allows storage of the long antenna element in a small space inside the car body without failure and allows the antenna element to be automatically extended and retracted by the electric mechanism.

4 Claims, 7 Drawing Sheets

ELECTRIC EXTENSIBLE CAR ANTENNA

BACKGROUND OF THE INVENTION

1. Field of the Invention

This invention relates to an electric extensible car antenna which uses a single small-diameter rod antenna element.

2. Prior Art

In many of the conventional electric extensible car antennas, telescopic extensible antenna elements comprising a plurality of conductive pipes of different diameters movably connected to one another are employed.

With an electric extensible car antenna in which an extensible antenna element of this type is used, there is a large risk that the antenna element and its surrounding areas will become damaged upon impact if an object comes into contact with the antenna element in its extended state while the car is running or being washed. In this case, the degree and location of damage varies depending on the type and size of the object making contact, as well as on the conditions under which the contact occurs.

However, in general, since the portions of the small diameter sections toward the proximal end of the antenna element are quite flexible, the degree of damage is relatively small in these areas. In contrast, the portions of the large diameter sections toward the distal end of the antenna element are not very flexible. Therefore, when an object such as a large washing roller touches it, for example, it may become sharply bent or even broken.

To avoid such a mishap, it is possible to employ an antenna element comprising a single rod having a small diameter, which provides great flexibility throughout the antenna element. However, an antenna element comprising a single rod having a small diameter has the following problems:

When such an antenna is used, the entire antenna element attains great flexibility. Because of this, even if a large force is exerted on the antenna element, the impact is greatly reduced by the resilience of the antenna element. Accordingly, there is a small risk of the antenna element being damaged or broken.

However, because the diameter of the antenna element is small throughout the antenna's entire length, it is naturally necessary to make the antenna element support member of an antenna attachment base small as well, which complicates construction and makes manufacturing difficult. In addition, the antenna element support member tends to invite rattling, which makes it difficult to attach the antenna element to the car body in a stable fashion.

Further, when an antenna element comprising a single rod having a small diameter is used, even when the antenna element is pulled into the car body for storage, the length of the antenna element itself does not become smaller. Therefore, there is a major problem regarding how to store the lengthy antenna element in a small space inside the car body. In addition, because it is difficult to move the long rod antenna element using an electric mechanism, it becomes difficult to create an electric extensible antenna.

SUMMARY OF THE INVENTION

Accordingly, the primary object of the present invention is to provide an electric extensible car antenna not only in which there is almost no risk of the antenna element being damaged or broken even if it comes into contact with an object, but also which has a simple construction and allows easy manufacturing, allows stable attachment of the antenna element to the car body, has great compatibility in terms of components, allows storage of the long single small-diameter rod antenna element in a small car body interior space and also allows automatic extension and retraction of the antenna element using an electric mechanism.

In order to accomplish the object, the present invention utilizes a unique structure for a car antenna which includes:

a. an antenna attachment base that may be attached to an antenna attachment hole in a car body panel, the antenna attachment base comprising a cylindrical support member and an antenna power supply member, and the cylindrical support member being formed such that it pierces through the car body panel when the antenna attachment base is attached to the car body panel;

b. an antenna element supporting cylinder detachably mounted on the end of the cylindrical support member of the antenna attachment base and protruding outside the car body panel, the antenna element supporting cylinder having an antenna element insertion hole at the center into which the antenna element is inserted;

c. a conductive contact element, a part of which protruding as a flexible contact member in the antenna element insertion hole of the antenna element supporting cylinder and the other part of which being located so as to provide continuity with the antenna power supply member;

d. a single small-diameter rod antenna element movably inserted in the antenna element insertion hole of the antenna element supporting cylinder in such a manner that its outer surface is in contact with the contact member of the conductive contact element;

e. an antenna element guiding tube, which is made of, for example, hard synthetic resin, and is placed so as to lead the proximal end of the antenna element, which is led toward the proximal end of the antenna element supporting cylinder, in a prescribed direction, the antenna element guiding tube being placed in a curved fashion between the proximal end of the antenna attachment base and a prescribed portion of the interior of the car body;

f. a flexible rope formed with a rack, one end of the rope being connected to the proximal end of the antenna element guided by the antenna element guiding tube;

g. an electric mechanism containing a pinion, which engages with the rack at the other end of the rope, the electric mechanism extending and retracting the antenna element by pushing it toward the distal end and pulling it toward the proximal end of the antenna element supporting cylinder via moving the rope in the vicinity of the opening at the proximal end of the antenna element guiding tube.

In the above structure, the antenna element is preferably made of an ultra-flexible material such as SUS 631, piano sire, NiTi, etc. Further, the antenna element supporting cylinder preferably comprises a plurality of separate cylindrical units which can be connected to and separated from one another, and in which auxiliary components, etc. can be incorporated in the connection areas between the separate cylindrical units.

As a result of the above structure, the following effect is obtained.

(1) Because a single small-diameter rod antenna element is used, the entire antenna element is flexible. As a result, even if a large force is inflicted on the antenna element, the impact is reduced by its flexibility. Accordingly, even if the antenna element comes into contact with an object, the risk of its becoming damaged or broken is very small.

(2) Because the separately formed antenna element supporting cylinder is installed in the antenna attachment base, accommodation for the "small diameter" of the antenna element can be made only on the antenna element supporting cylinder, which is a separate component from the antenna attachment base and is simple in design. Therefore, the antenna attachment base, which has a complex construction including the antenna power supply member, need not be made complicated in order to make its inner diameter smaller. Thus, the entire antenna assembly is simple, and its manufacture is easy.

In addition, since the antenna element supporting cylinder is made of a plurality of separate cylindrical units which can be combined and separated from one another and in which auxiliary components may be incorporated in the connection areas between the separate cylindrical units, the manufacturing of the antenna element supporting cylinder itself is simplified.

Thus, rattling does not easily occur at the antenna element support member of the antenna attachment base, making it possible to mount the antenna element to the car body in a stable manner.

(3) The antenna element supporting cylinder is detachable relative to the cylindrical support member of the antenna attachment base. Therefore, the antenna element which is a single rod having a small diameter can be easily removed from the antenna attachment base together with the antenna element supporting cylinder for repair and replacement. Thus, the car antenna of the present invention has high compatibility.

(4) The single small-diameter rod antenna element which is led toward the proximal end of the antenna element supporting cylinder is guided in a certain direction by the antenna element guiding tube, which is made of, for example, hard synthetic resin, and which is placed in a certain curved fashion in the interior of the car body. Therefore, though the antenna element is lengthy, the antenna element can be appropriately stored in a certain area in the relatively small interior of the car body. The antenna element moves smoothly inside the antenna element guiding tube via the rack-equipped flexible rope which is moved by the electric mechanism. Thus, an automatic extension and retraction of the single small-diameter rod antenna element, which conventionally has been seen as difficult, can be realized.

DETAILED DESCRIPTION OF THE INVENTION

Figure 1:
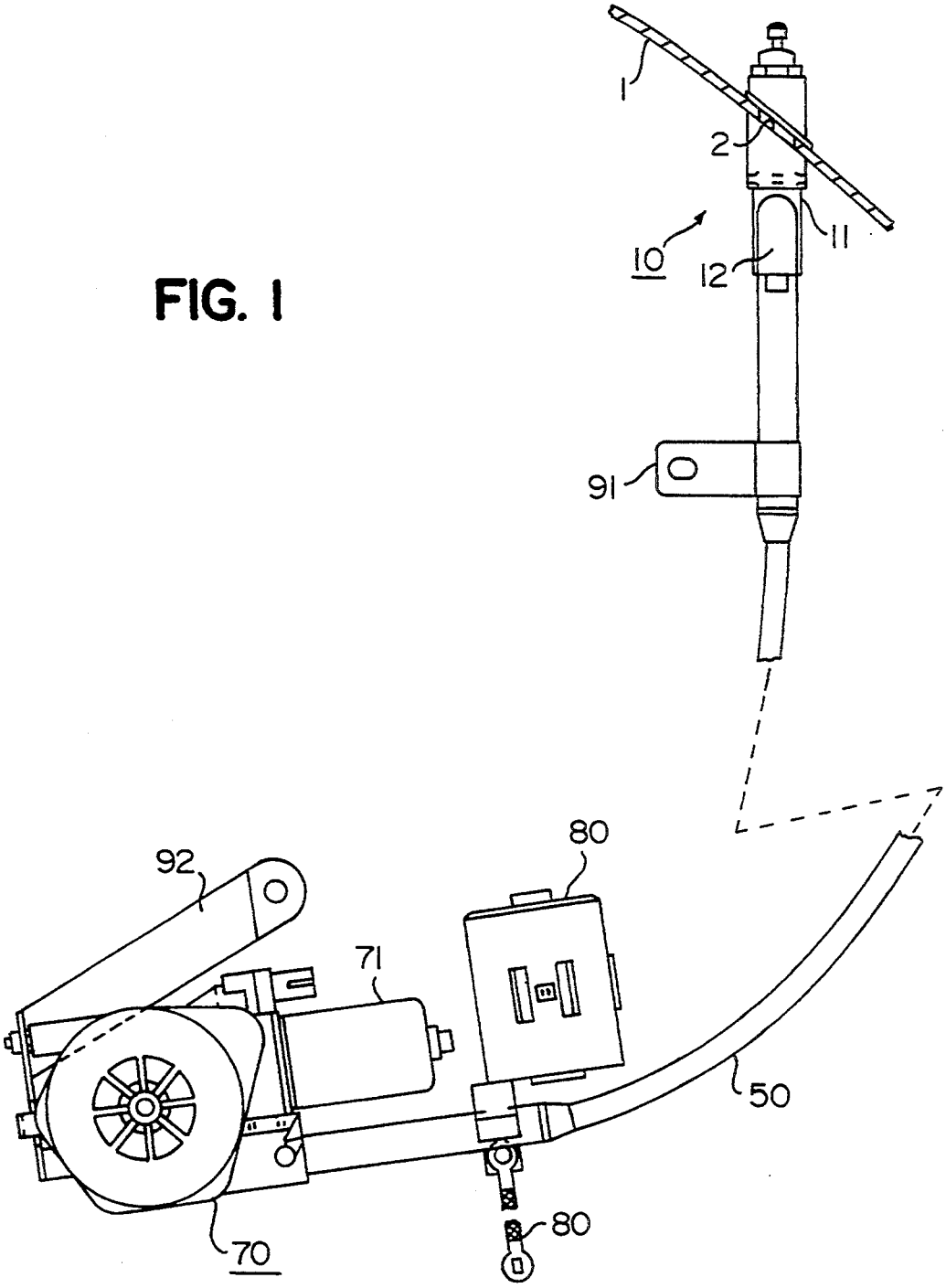
FIG. 1 is a schematic view showing the attachment of an electric extensible car antenna to a car body according to one embodiment of the present invention.
Figure 2:
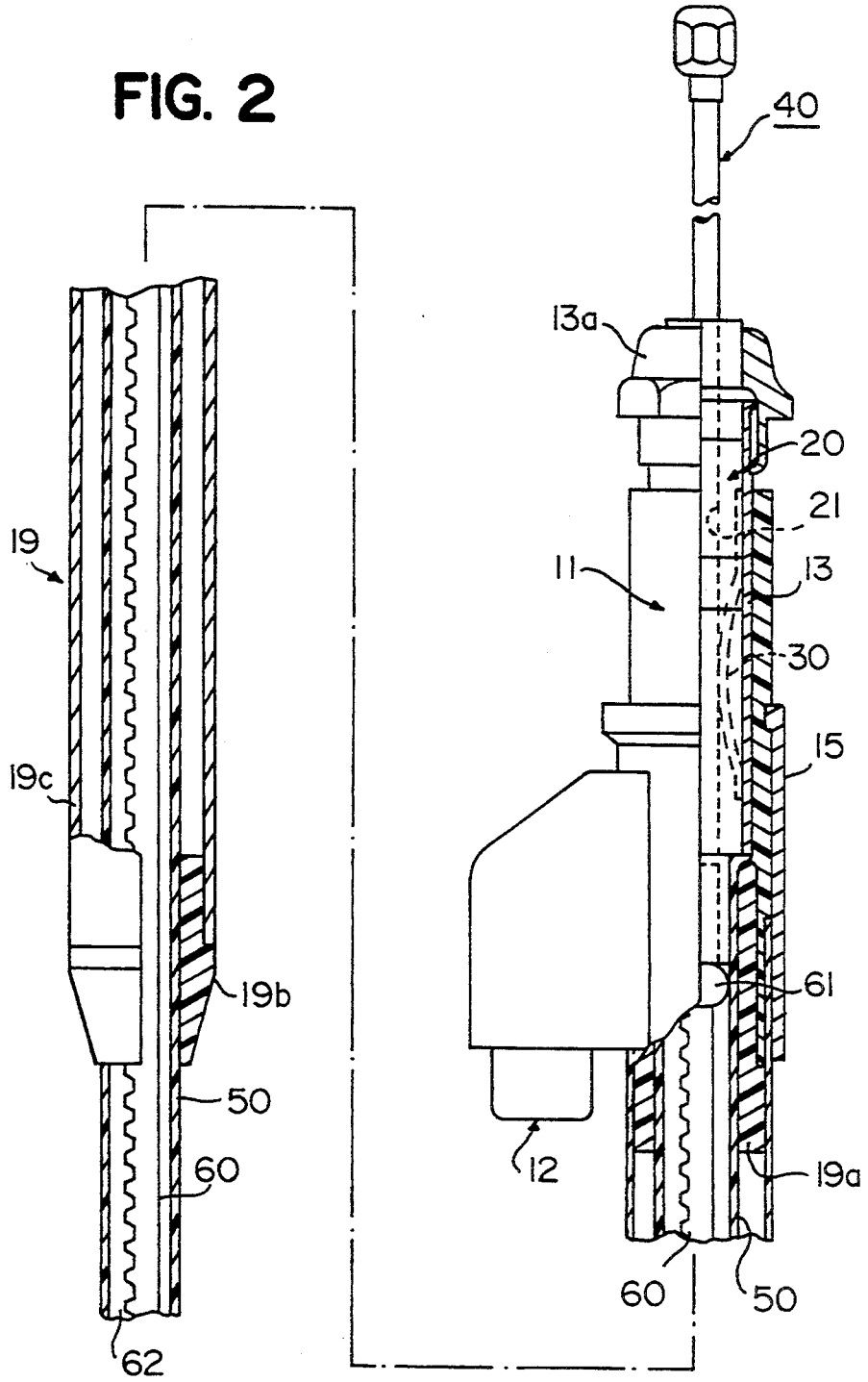
FIG. 2 is a side elevational view thereof, the upper portion of the car antenna being cross-sectioned.
Figure 5:
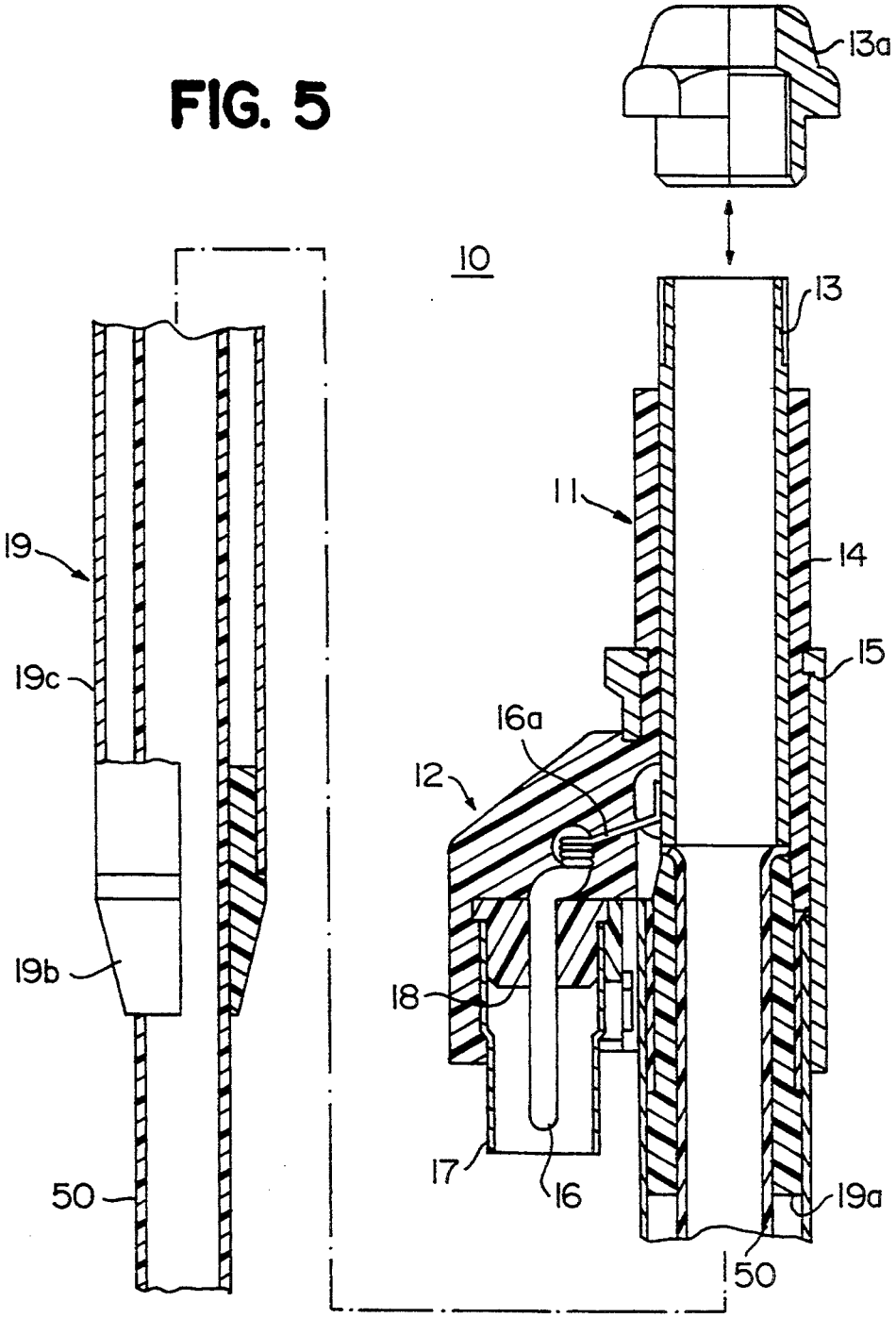
FIG. 5 is a side elevational view thereof, the antenna attachment base of the car antenna being cross-sectioned.

As shown in FIGS. 1, 2 and 5, an antenna attachment base 10 is constructed such that it can be attached to an antenna attachment hole 2 of a car body panel 1. The antenna attachment base 10 has a cylindrical support member 11 and an antenna power supply member 12. The cylindrical support member 11 is formed such that it pierces through the car body panel when the antenna attachment base 10 is attached to the car body panel 1.

As shown in detail in FIG. 5, the cylindrical support member 11 comprises a hot conductive pipe 13 having a fixing nut 13*a* screwable at the top, a resinous cylindrical member 14 and a ground conductive pipe 15. The antenna power supply member 12, also shown in detail in FIG. 5, has a connector for the connection of a coaxial cable in which the central conductor 16 and the outer conductor 17 are coaxially supported by insulation spacer 18. The central conductor 16 is connected to a hot conductive pipe 15 via lead wire 16*a* via an appropriate connecting method such as soldering. Antenna element guiding tube connecting cylinder 19 is for connecting antenna element guiding tube 50, to be described below, to the proximal end of the attachment base 10, and it comprises a pair of circular support members 19*a* and 19*b*, which are placed over the neck of the antenna element guiding tube 50 at a certain distance and connected by connecting pipe 19*c*.

Figure 6:
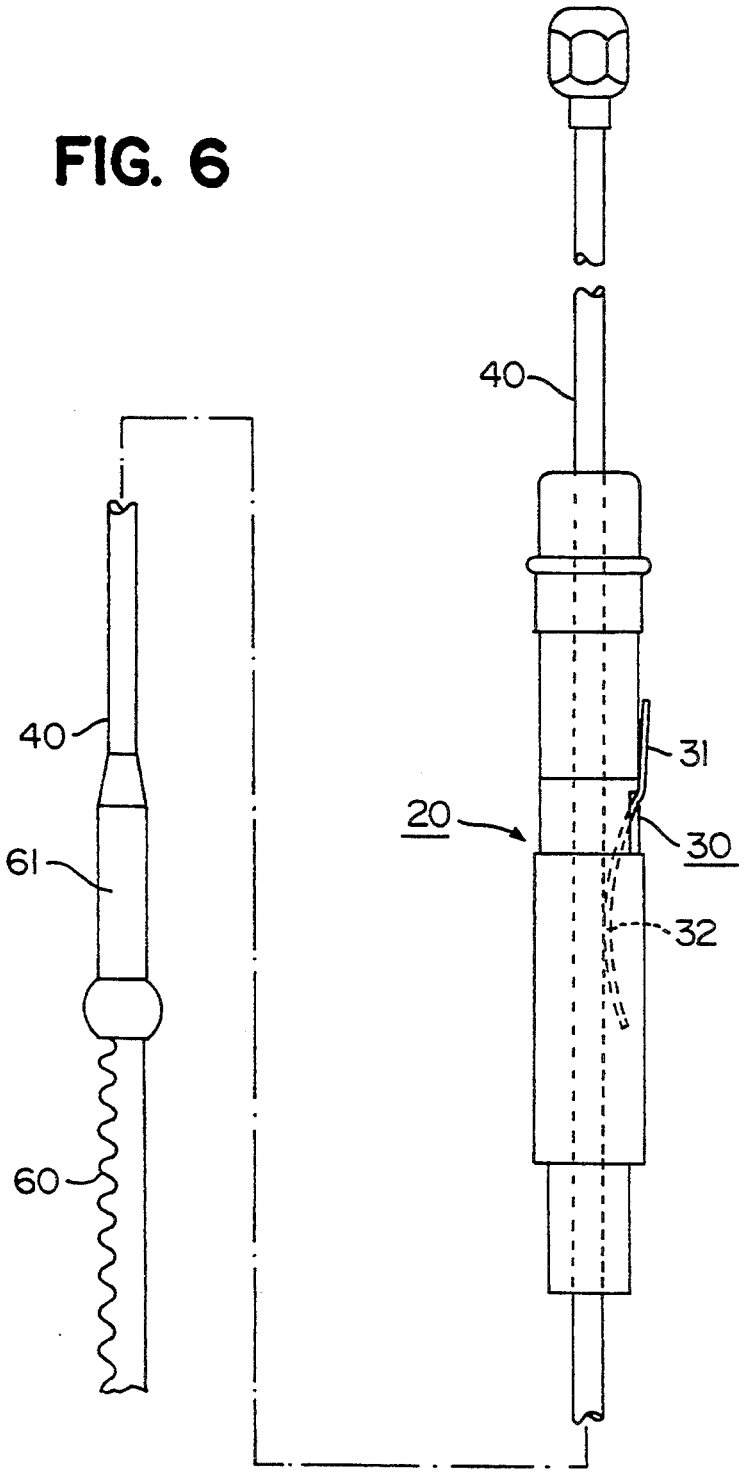
FIG. 6 is a side elevational view of the exterior of the antenna element supporting cylinder and the antenna element of the car antenna.

As shown in FIG. 2, the antenna element supporting cylinder 20 is installed in the cylindrical support member 11 of the antenna attachment base 10 in a detachable fashion. In other words, the antenna element supporting cylinder 20 is brought into the cylindrical support member 11 from the end that protrudes outside the car body. Thus, the antenna element supporting cylinder 20 is detachably mounted to the protruded upper end of the cylindrical support member 11 (see FIG. 1). In other words, the antenna element supporting cylinder 20 has the appearance and shape as shown in FIG. 6 and is constructed such that, together with the antenna element 40, it can be inserted into and retracted from the hot conductive pipe 13 after the fixing nut 13*a* is removed from the top as shown in FIG. 5. The insertion and retraction of the antenna element supporting cylinder 20 is performed at the protruded end of the cylindrical support member 11 that protrudes outside the car body; in other words, such is performed from the upper side in the drawing. Incidentally, the antenna element supporting cylinder 20 inserted in the hot conductive pipe 13 is fixed in the hot conductive pipe 13 in a stable fashion by screwing the fixing nut 13*a* to the top of the hot conductive pipe 13.

Figure 7A:
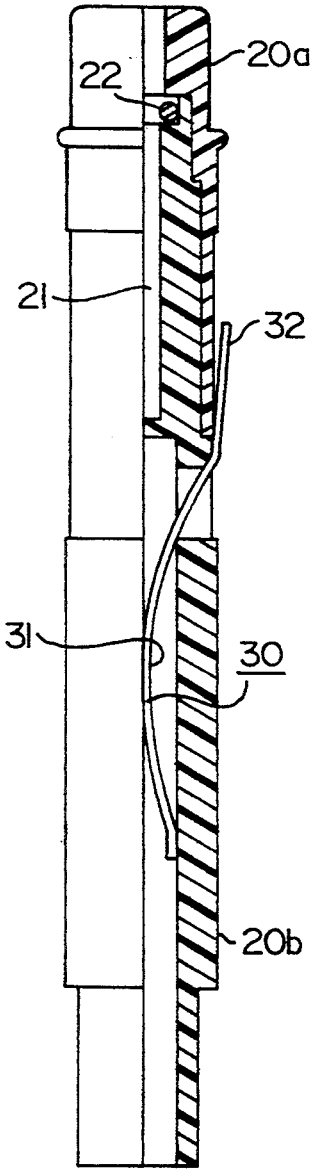
FIGS. 7(*a*) and 7(*b*) are side elevational views showing the construction of the antenna element supporting cylinder, the right half of which being cross-sectioned.
Figure 7B:
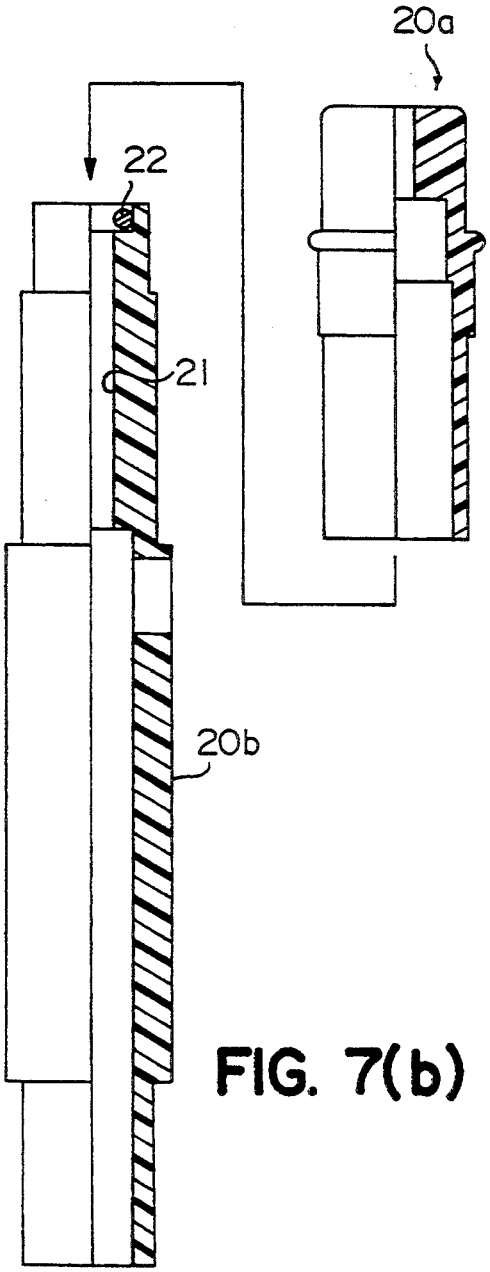

As shown in detail in FIG. 7, an antenna element insertion hole 21 in which the antenna element 40 is inserted is provided at the center of antenna element supporting cylinder 20. The antenna element supporting cylinder 20 is made of separate cylindrical units 20*a* and *20*b which can be connected to and separated from each other (two units are utilized in this embodiment). Thus, both separate cylindrical units 20*a* and 20*b* are integrally connected as shown in FIG. 7(*a*) by incorporating an auxiliary component, namely O-ring 22, in the step portion located in the inner circumference of the top portion of one separate cylindrical unit 20*b* when the cylindrical units 20*a* and 20*b* are separated as shown in FIG. 7(*b*), and then by screwing the other separate cylindrical unit 20*a* around the outer circumference of the top portion of the cylindrical unit 20*b*.

In the center of antenna element supporting cylinder 20 is attached a conductive contact element 30. A part (first part) of the conductive contact element 30 protrudes inside the antenna element insertion hole 21 in the shape of an arc as a flexible contact member 31, and the other part (second part) of the contact element 30 is exposed on the outer surface of the antenna element supporting cylinder 20 as a conductive member 32. As described above, the conductive member 32 comes into contact with the inner surface of the conductive pipe 13 and provides continuity with the antenna power supply member 12 through the conductive pipe 13 when antenna element supporting cylinder 20 is inserted in the conductive pipe 13 inside the antenna attachment base 10. In the center of the antenna element supporting cylinder 20 is inserted a single small-diameter rod antenna element 40 as shown in FIG. 6.

The small-diameter rod antenna element 40 is movably inserted in the antenna element insertion hole 21 of the antenna element supporting cylinder 20 so that its outer surface is in contact with the contact member 31 of the conductive contact element 30. The antenna element 40 is made of an ultra-flexible material such as SUS 631, piano wire, NiTi, etc. so that it is sufficiently flexible. As shown in FIGS. 2 and 5, the distal end of the antenna element guiding tube 50 is connected to the proximal end of antenna attachment base 10 is connected so that it is connected to the proximal end of antenna element supporting cylinder 20.

The antenna element guiding tube 50 is made of, for example, a hard synthetic resin, and is placed between the proximal end of the antenna attachment body 10 and a prescribed point in the interior of the car body in a prescribed fashion. In this embodiment, it is placed in a curved circular arc as shown in FIG. 1. Thus, the antenna element guiding tube 50 guides the proximal portion of the antenna element 40 led toward the proximal end of the antenna element supporting cylinder 20 (the lower end in the drawing) in a prescribed direction. At the proximal end of the antenna element 40 is connected one end of the rack-equipped flexible rope 60 for the operation of the antenna element through joint 61. The entire bulge at the proximal end of the joint 61 is rounded so that the movement against the antenna element guiding tube 50 can be smooth.

Figure 3:
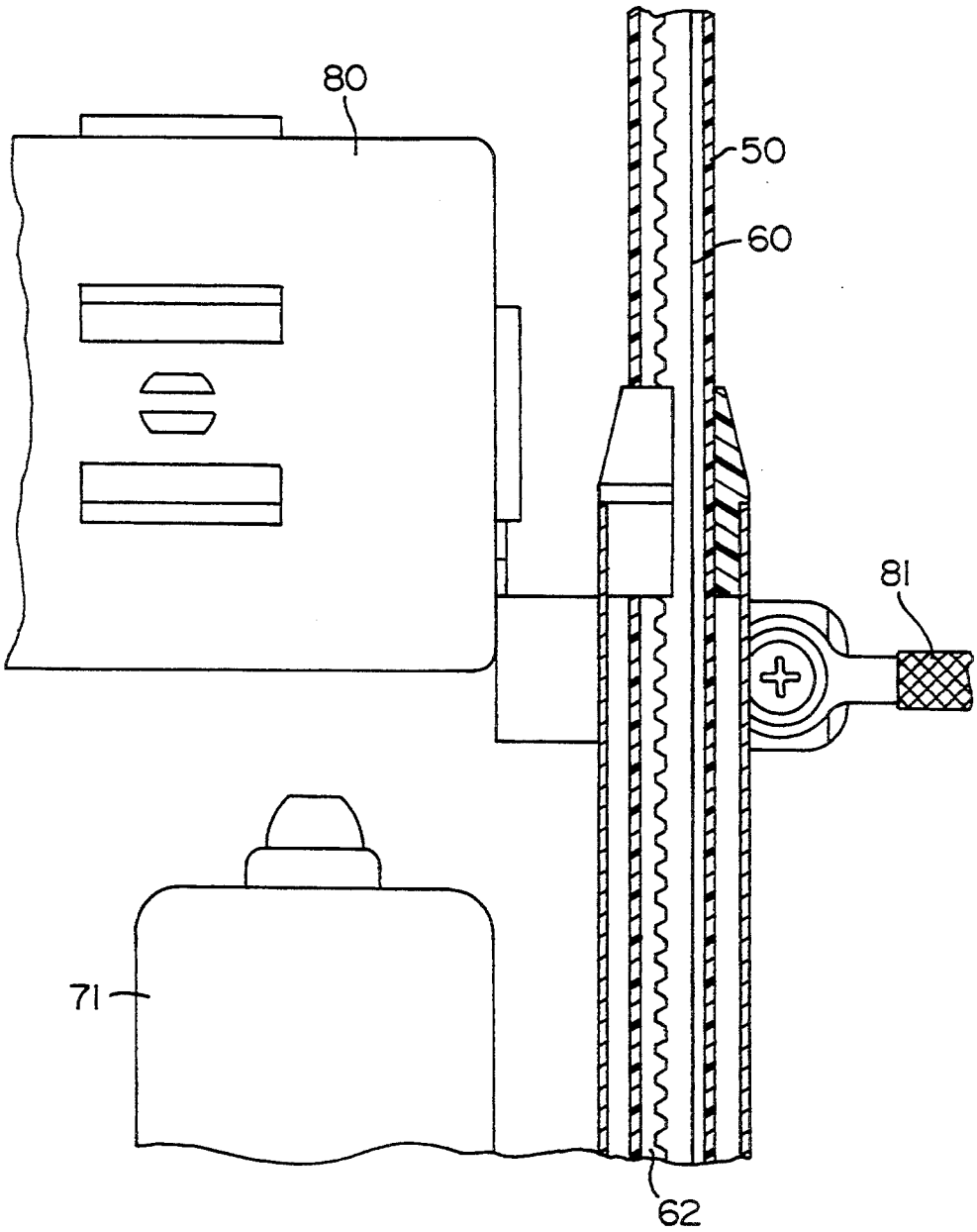
FIG. 3 is a side elevational view thereof, the middle portion of the car antenna being cross-sectioned.
Figure 4:
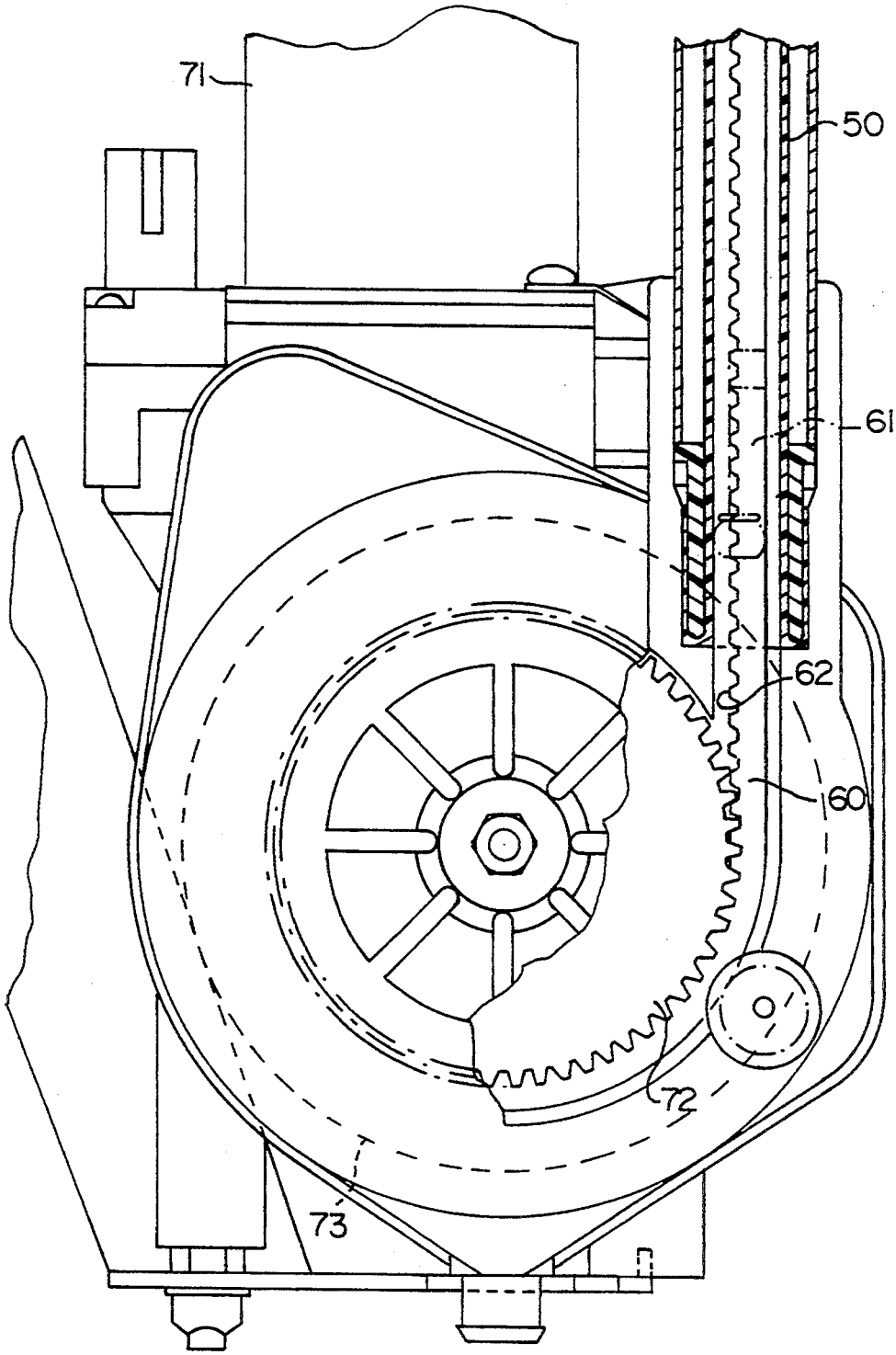
FIG. 4 is a side elevational view thereof, the lower portion of the electric extensible car antenna being cross-sectioned.

The flexible rope 60 having a rack is made of, for example, a hard synthetic resin. As shown in FIGS. 2 through 4, the rack 62 which engages with a rope drive pinion 72 of the electric mechanism 70, to be described below, is formed lengthwise on the outer surface of the flexible rope 60. The rack-equipped flexible rope 60 is movably provided inside the antenna element guiding tube 50 and the antenna element supporting cylinder 20 so that the rope 60 can move together with the antenna element 40. The other end of the rack-equipped flexible rope 60 is wound and unwound by electric mechanism 70 connected to the opening which is provided at the proximal end of the antenna element guiding tube 50.

The mechanism 70 includes a rope drive pinion 72 and a rotation drum 73. The pinion 72 is supplied with power from a motor 71 and rotates via a reduction gear (not shown in the drawing) and engages with the rack 62 of the flexible rope 60, thus moving the rope 60 in its length-wise direction. The rotation drum 73 rotates to store the rack-equipped flexible rope 60 in a windable/unwindable fashion. Thus, the antenna element 40 is extended and retracted by the electric mechanism 70 which pushes and pulls the antenna element 40 toward the distal end and the proximal end of antenna element supporting cylinder 20.

Incidentally, the reference numeral 80 in FIG. 1 is a control box which controls the rotation of the motor, and 81 is its grounding terminal. Fixing members 91 and 92 positionally fix the antenna attachment base 10 and electric mechanism 70 to the car body.

The antenna constructed as described above has the following effect.

(1) Because the highly flexible single small-diameter rod antenna element 40 is used, even if a large force is inflicted thereon while the car is running or being washed, the impact is reduced due to the flexibility of the antenna element 40. Accordingly, the risk of antenna element 40 being damaged or broken is very small.

(2) The antenna attachment unit comprises the combination of separately formed attachment base 10 and antenna element supporting cylinder 20. Consequently, accommodation for the "small diameter" of the antenna element 40 should be made only on the antenna element supporting cylinder 20, which is a separate component from the antenna attachment base 10 and which has a simple construction. Therefore, the antenna attachment base 10, which has a complex construction including the antenna power supply member 12, need not be made more complicated in order to make its inner diameter smaller. Thus, the entire construction is simple and manufacturing is easier.

In addition, the antenna element supporting cylinder 20 comprises a plurality of separate cylindrical units which can be connected to and separated from each other, and auxiliary components may be incorporated in the connection ares between the separate cylindrical units. Accordingly, the manufacturing of antenna element supporting cylinder 20 itself is simplified. Since the antenna element 40 is supported by the antenna element supporting cylinder 20 having the above construction, rattling does not easily occur at the antenna element support member of the antenna attachment base 10. Therefore, it becomes possible to attach the single small-diameter antenna 40 to the car in a stable fashion.

(3) The antenna element support cylinder 20 is detachable relative to the cylindrical support member 11 of the antenna attachment base 10. As a result, the antenna element 40, which is a small diameter rod, can be removed from the antenna attachment base 10 in the state as shown in FIG. 5, together with the antenna element supporting cylinder 10 in a manner as shown in FIG. 6, for repair and replacement. In other words, the antenna of the present invention has great compatibility.

(4) The small-diameter rod antenna element 40 which is led toward the proximal end of the antenna element supporting cylinder 20 is guided in a certain direction by the antenna element guiding tube 50, which is made of, for example, a hard synthetic resin, and is placed in a curved fashion in the interior of the car body. Therefore, despite the fact that the antenna element 40 is lengthy, it can be appropriately stored in a certain area in the relatively small interior of the car body by filling areas such as dead space inside the car body. Moreover, the antenna element 40 can smoothly move inside the antenna element guiding tube 50 via the rack-equipped flexible rope 60 which is moved by the electric mechanism 70. Thus, an automatic extension and retraction of the rod antenna element 40, which conventionally has been seen as difficult, can be realized.

The present invention is not limited to the above embodiment and can naturally be embodied in various different forms within the spirit of the invention.

According to the present invention: (a) the antenna element supporting cylinder that comprises integrally connected multiple separate cylindrical units is detachably mounted to a cylindrical support member of an antenna attachment base from the outside of the car body; (b) a single small-diameter rod antenna element made of an ultra-flexible material is inserted in the antenna element insertion hole of the support cylinder so as to be in contact with a conductive contact element; (c) the proximal end of the antenna element which is led toward the proximal end of the support cylinder is guided in a prescribed direction by an antenna element guiding tube; and (d) a flexible rope that is equipped with a rack and connected to the antenna element is moved by an electric mechanism so that the antenna element is extended and retracted. Accordingly, even if the antenna element comes into contact with an object, the antenna has a very small risk of becoming damaged or broken with a simple construction. In addition, the antenna allows easy manufacturing and stable attachment of the antenna element to the car, is highly compatible in terms of components, allows storage of the long single small-diameter rod antenna element in a small space inside the car body without failure and further allows the single small-diameter rod antenna element to be automatically extended and retracted via the electric mechanism.

We claim:

1. An electric extensible car antenna comprising:

an antenna attachment base mountable to an antenna attachment hole of a car body panel and provided with a cylindrical support member and an antenna power supply member, said support member piercing out of said car body panel when said antenna attachment base is mounted to said car body panel;

an antenna element supporting cylinder having an antenna element insertion hole at a center thereof, said antenna element supporting cylinder being detachable to an end of said cylindrical support member of said antenna attachment base, and said end protruding out of said car body panel;

a conductive contact element, one part thereof protruding as a flexible contact member into said antenna element insertion hole of said antenna element supporting cylinder and another part of said contact element being located so as to provide a continuity with said antenna power supply member;

a single small-diameter rod antenna element forming an antenna mast movably inserted in said antenna element insertion hole of said antenna element supporting cylinder, an outer surface of said antenna element being in contact with said contact portion of said conductive contact element;

an antenna element guiding tube provided in a curved fashion between a proximal end of said antenna attachment base and a prescribed portion of an interior of a car body, so as to guide a proximal end of said antenna element in a prescribed direction toward proximal end of said antenna element supporting cylinder;

a flexible rope equipped with a rack so as to move said antenna element, a first end of said rope is connected to proximal end of said antenna element guided by said antenna element guiding tube; and an electric mechanism containing a pinion which engages with said rack of a second end of said flexible rope so as to move said flexible rope, said electric mechanism extending and retracting said antenna element by pushing said rope toward a distal end and pulling said rope toward a proximal end of said antenna element supporting cylinder near an opening which is provided at a proximal end of said antenna element guiding tube.

2. An electric extensible car antenna according to claim 1, wherein said antenna element is made of an ultra-flexible material.

3. An electric extensible car antenna according to claim 2, wherein said ultra-flexible material is one selected from the group consisting of SUS 631, piano wire and NiTi.

4. An electric extensible car antenna according to claim 1, wherein said antenna element supporting cylinder comprises a plurality of separate cylindrical units which can be connected to and separated from each other and in which auxiliary components may be incorporated in connection areas between said separate cylindrical units.

* * * * *